US005148821A

United States Patent [19]

Best et al.

[11] Patent Number: 5,148,821

[45] Date of Patent: Sep. 22, 1992

[54] PROCESSES FOR PRODUCING A SMOKABLE AND/OR COMBUSTIBLE TOBACCO MATERIAL

[75] Inventors: Freddie W. Best, Winston-Salem; Jackie L. White, Pfafftown, both of N.C.

[73] Assignee: R. J. Reynolds Tobacco Company, Winston-Salem, N.C.

[21] Appl. No.: 569,325

[22] Filed: Aug. 17, 1990

[51] Int. Cl.[5] ..... A24B 15/12

[52] U.S. Cl. ..... 131/370; 131/372; 131/375; 131/356

[58] Field of Search ..... 131/370, 372, 375, 356

[56] References Cited

U.S. PATENT DOCUMENTS

| | | | |
|---|---|---|---|
| 2,907,686 | 6/1959 | Siegel . | |
| 3,738,374 | 6/1973 | Bennett . | |
| 3,744,496 | 7/1973 | McCarty et al. . | |
| 3,746,012 | 7/1973 | Deszyck | 131/370 |
| 3,834,398 | 9/1974 | Briskin et al. . | |
| 3,874,390 | 4/1975 | Eicher et al. . | |
| 3,885,574 | 5/1975 | Borthwick et al. . | |
| 3,902,504 | 9/1975 | Owens, Jr. et al. . | |
| 3,911,932 | 10/1975 | Houck, Jr. et al. . | |
| 3,924,644 | 12/1975 | Anderson et al. . | |
| 3,943,941 | 3/1976 | Boyd et al. . | |
| 3,993,082 | 11/1976 | Martin et al. . | |
| 4,044,777 | 8/1977 | Boyd et al. . | |
| 4,133,317 | 1/1979 | Briskin . | |
| 4,219,031 | 8/1980 | Rainer et al. . | |
| 4,286,604 | 9/1981 | Ehretsmann et al. . | |
| 4,326,544 | 4/1982 | Hardwick et al. . | |
| 4,366,824 | 1/1983 | Rainer et al. | 131/370 |
| 4,481,958 | 11/1984 | Rainer et al. . | |
| 4,596,259 | 6/1986 | White et al. . | |
| 4,771,795 | 9/1988 | White et al. . | |
| 4,858,630 | 8/1989 | Banerjee et al. | 131/370 |
| 4,880,018 | 11/1989 | Graves, Jr. et al. | 131/375 |
| 4,920,990 | 5/1990 | Lawrence et al. . | |
| 5,007,440 | 4/1991 | Robinson et al. | 131/370 |
| 5,016,654 | 5/1991 | Bernasek . | |

FOREIGN PATENT DOCUMENTS

| | | |
|---|---|---|
| 117355 | 7/1986 | European Pat. Off. . |
| 342538 | 12/1988 | European Pat. Off. . |

*Primary Examiner*—V. Millin
*Assistant Examiner*—Lynne Reichard
*Attorney, Agent, or Firm*—Bell, Seltzer, Park & Gibson

[57] ABSTRACT

Smokable and/or combustible tobacco material is provided by altering the character of tobacco material.

Tobacco material is extracted using a solvent to provide a tobacco extract within the solvent and an extracted tobacco material. The extracted tobacco material is separated from at least a portion of the extract and solvent. The extracted tobacco material is subjected to pyrolysis conditions to provide a pyrolyzed material. The pyrolysis conditions can include a temperature of from about 300° C. to about 1250° C. and a non-oxidizing atmosphere.

The pyrolyzed material can then be formed into a predetermined shape such as by extrusion, casting and the like.

34 Claims, 1 Drawing Sheet

PROCESSES FOR PRODUCING A SMOKABLE AND/OR COMBUSTIBLE TOBACCO MATERIAL

BACKGROUND OF THE INVENTION

The present invention relates to smokable and/or combustible material, and in particular to processes for providing such material by the pyrolysis of tobacco material.

Popular smoking articles, such as cigarettes, have a substantially cylindrical rod shaped structure and include a charge of smokable material, such as shreds of strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. No. 4,708,151 to Shelar; U.S. Pat. No. 4,714,082 to Banerjee et al.; U.S. Pat. No. 4,756,318 to Clearman et al.; U.S. Pat. No. 4,793,365 to Sensabaugh, Jr. et al.; 4,917,128 to Clearman et al.; U.S. Pat. No. 4,938,238 to Barnes et al.; U.S. Pat. No. 4,928,714 to Shannon; U.S. Pat. No. 4,893,639 to White; and U.S. Pat. No. 4,827,950 Banerjee et al.; and European Patent Publication Nos. 212,234 and 277,519 propose cigarettes and pipes which comprise a fuel element, an aerosol generating means physically separate from the fuel element, and a separate mouthend piece. Such types of smoking articles are capable of providing natural tobacco flavors to the smoker thereof by heating without necessarily burning tobacco in various forms.

There has been interest in smokable and combustible tobacco material other than conventionally processed tobaccos. For example, several patents have proposed the production of smokable materials having a high carbon content. These include U.S. Pat. No. 2,907,686 to Siegel, U.S. Pat. No. 3,738,374 to Bennett, U.S. Pat. No. 3,885,574 to Borthwick et al, U.S. Pat. No. 3,943,941 and U.S. Pat. No. 4,044,777 to Boyd et al., U.S. Pat. No. 4,002,176 to Anderson et al. U.S. Pat. No. 4,019,521 and U.S. Pat. No. 4,133,317 to Briskin, U.S. Pat. No. 4,219,031 to Rainer, U.S. Pat. NO. 4,286,604 to Ehretsmann et al., U.S. Pat. No. 4,326,544 to Hardwick et al., U.S. Pat. No. 4,481,958 to Raíner et al., U.S. Pat. No. 4,244,381 to Lendvay U.S. Pat. No. 4,256,123 to Lendvay et al, U.S. Pat. No. 4,771,795 to White et al. and U.S. Pat. No. 4,920,990 to Lawrence et al. and Great Britain Patent Nos. 956,544 to Norton and 1,431,045 to Boyd et al., and European Patent Application No. 117,355 to Hearn, et al and No. 236,992 to Farrier et al. In addition, U.S. Pat. No. 3,738,374 to Bennett proposes that tobacco substitutes may be made from carbon or graphite fibers, mat or cloth, most of which are made by the controlled heating of various cellulosic materials.

It would be highly desirable to alter the character of tobacco material by pyrolyzing extracted tobacco material to form a pyrolyzed material. The pyrolyzed material can be used as a smokable and/or combustible tobacco material in various smoking articles.

SUMMARY OF THE INVENTION

The present invention relates to a process for altering the character of a tobacco material. In particular, the process involves providing smokable and/or combustible tobacco material from pyrolyzed tobacco material for use in various forms of cigarettes and smoking articles. The tobacco material is extracted using a solvent to provide (i) a tobacco extract within the solvent and (ii) an extracted tobacco material. The extracted tobacco material is separated from at least a portion of the extract and solvent. The extracted tobacco material is then subjected to pyrolysis conditions to provide a pyrolyzed material. Preferably, the pyrolysis conditions include a temperature of from about 300° C. to about 1250° C. and a non-oxidizing atmosphere. Various smokable and/or combustible tobacco material can be formed from the pyrolyzed material. For example, the pyrolyzed material can be contacted with a tobacco extract to provide a tobacco-derived smokable product. This tobacco extract optionally can be tobacco extract within the solvent provided in the step of extracting the tobacco material. Additionally the pyrolyzed material can be contacted with aerosol-forming materials, flavoring agents and the like.

Most desirably, the pyrolyzed material is formed into a smokable and/or combustible tobacco material by forming the pyrolyzed material into a predetermined shape. For example, in one embodiment, the pyrolyzed material is admixed with sufficient liquid to make a formable paste, the paste formed into a combustible fuel element of predetermined shape and dried. The combustible fuel element is useful in certain types of smoking articles.

In another embodiment, the pyrolyzed tobacco material is admixed with sufficient liquid to form a slurry and cast into a sheet-like predetermined shape. The slurry can include an inorganic filler material, binders, aerosol-forming materials, flavoring agents and the like. Such as sheet can be formed (i.e., cut or shredded) into cut filler and used as a reconstituted tobacco material.

In yet another embodiment, the pyrolyzed tobacco material is admixed with a binder, and the mixture is subjected to extrusion conditions sufficient to provide a tobacco-derived smokable and/or combustible extrudate.

The pyrolyzed material and the various smokable and/or combustible tobacco material provided can be used in smoking products using techniques known in the art. For example, such pyrolyzed material and the smokable and/or combustible tobacco materials produced therefrom are useful (i) in the manufacture of reconstituted tobacco material or (ii) in fuel elements as a high carbon content tobacco material or a flavor substrate in smoking articles such as are described in U.S. Pat. No. 4,708,151 to Shelar; U.S. Pat. No. 4,714,082 to Banerjee et al.; U.S. Pat. No. 4,756,318 to Clearman et al.; U.S. Pat. No. 4,793,365 to Sensabaugh, Jr. et al.; U.S. Pat. No. 4,917,128 to Clearman et al.; U.S. Pat. No. 4,938,238 to Barnes et al.; U.S. Pat. No. 4,928,714 to Shannon; U.S. Pat. No. 4,893,639 to White; and U.S. Pat. No. 4,827,950 Banerjee et al.; and European Patent Publication Nos. 212,234 and 277,519 all herein incorporated by reference.

DETAILED DESCRIPTION OF THE PREFERRED EMBODIMENTS

Figure 1:
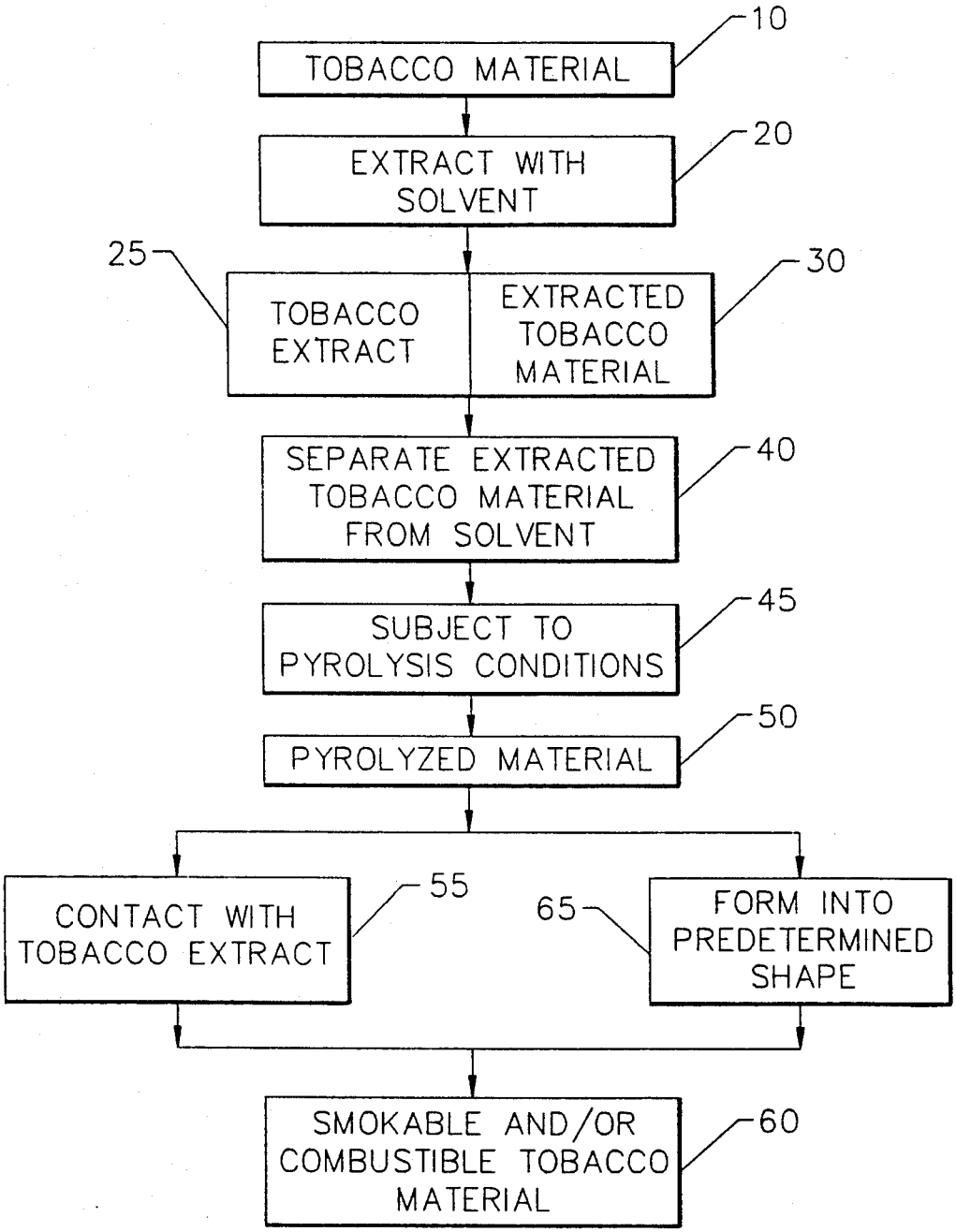
FIG. 1 is a schematic diagram of process steps representative of the present invention.

Referring to FIG. 1, tobacco material 10 is extracted 20. With a solvent to proVide a tobacco extract 25 within the solvent and an extracted tobacco material 30.. The extracted tobacco material 30 is separated 4o from the solvent and subjected 45 to pyrolysis conditions to provide a pyrolyzed material 50.

Optionally, the pyrolyzed material 50 is contacted 55 with a tobacco extract to form a smokable and/or combustible tobacco product 60. The tobacco extract can be the tobacco extract 25 within the solvent.

In another embodiment, the pyrolyzed material 50 is formed 65 into a predetermined shape such as a fuel element by forming it into a paste, by forming into a slurry, casting, by extrusion, or by other techniques known to those skilled in the art.

The tobacco materials useful herein can vary. Tobacco materials which are used are of a form such that under extraction conditions, a portion thereof is soluble in (i.e., extracted by) an extraction solvent; and a portion thereof is insoluble in (i.e., not extracted by) that extraction solvent. A typical insoluble tobacco material includes components of the biopolymer matrix of the tobacco. Examples of suitable types of tobaccos include flue-cured, Burley, Maryland and Oriental tobaccos, as well as the rare or specialty tobaccos. The tobacco material generally has been aged, and can be in the form of laminae and/or stem, or can be in processed form. Tobacco waste materials and processing by-products such as fines, dust, scrap, stems and stalks can be employed. Unaged, uncured mature, or immature tobaccos also can be employed. The aforementioned tobacco materials can be processed separately, or as blends thereof.

An extracted tobacco material can be provided in a number of ways. In particular, the tobacco material is subjected to extraction conditions with a suitable solvent to extract a sufficient amount of the desired components from the tobacco material. The manner in which the tobacco material is extracted, and the type of solvent employed, can vary. For example, the tobacco material can be extracted using organic solvents (e.g., hexane, methanol or ethanol), halocarbons and halogenated hydrocarbons, supercritical fluids (e.g., supercritical carbon dioxide and the like. Preferably, the extracted tobacco material is provided by extracting the tobacco material using a liquid having an aqueous character. Such a liquid consists primarily of water, normally greater than about 90 weight percent water, and can be essentially pure water in certain circumstances. For example, a solvent having a aqueous character can be distilled water, tap water, or the like. However, a solvent having an aqueous character can include water having substances such as pH buffers, pH adjusters, organic and inorganic salts, sugars, amino acids or surfactants incorporated therein. The solvent also can be a cosolvent mixture of water and minor amounts of one or more solvents which are miscible therewith. Other methods for extracting components from tobacco materials will be apparent to the skilled artisan.

A wide variety of components can be extracted from the tobacco material. The particular components and the amounts of the particular components which are extracted often depend upon the type of tobacco material which is processed, the properties of the particular solvent, and the extraction conditions (e.g., which include the temperature at which the extraction occurs as well as the time period over which the extraction is carried out). Typically, at least about 10 percent, preferably about 20 percent, more preferably about 30 percent, and most preferably at least about 35 percent of the weight of the starting tobacco material (on a dry weight basis) is extracted and the extract removed from the extracted tobacco material. For example, about 40 percent to about 50 percent of the tobacco material can be extracted using an extraction solvent consisting essentially of pure water. Pure water will most often extract primarily and substantially all of the water soluble components of the tobacco material, while a co-solvent mixture of water and a minor amount of an alcohol can extract the water soluble components of the tobacco material as well as certain amounts of tobacco components having other solubility characteristics.

The extraction solvent and tobacco extract therewithin then are separated from the extracted tobacco material (i.e., the insoluble tobacco residue). The manner of separation can vary; however, it is convenient to employ conventional separation techniques using presses, filters, centrifuges, screw presses, rotating disk presses, converging belts, or the like. Preferably, the extracted tobacco material is treated so as to remove a predetermined amount of solvent and tobacco extract therefrom.

The solvent and tobacco components extracted thereby can be filtered to remove suspended insoluble particles; concentrated; diluted with solvent; or spray dried, freeze dried, or otherwise processed, particularly for storage or handling reasons. The tobacco extract can be retained for later use in making smokable and/or combustible tobacco material.

The extracted tobacco material also can be treated so as to remove a desired amount of remaining extraction solvent therefrom. In particular, essentially all of the solvent or a relatively minor amount of the solvent can be separated from the extracted tobacco material. Typically, the extraction solvent is vaporized by heating the extracted tobacco material (e.g., in a hot air column, rotary dryer, apron dryer, or the like). The extracted tobacco material can be air dried, if desired. The extracted tobacco material is provided at a moisture level suitable for pyrolysis treatment. Typically, the extracted tobacco material is provided at a moisture level of about 15 to about 50 weight percent, often about 18 to about 40 weight percent, and typically about 23 to about 35 weight percent.

The extracted tobacco material is subjected to pyrolysis conditions by heating the extracted tobacco material at temperatures of 300° C. to 1250° C., preferably about 400° C. to 1000° C. and typically about 500° C. to 800° C. in an inert or non-oxidizing atmosphere for periods of 0.5 to 3 hours in length. Heating of the extracted tobacco materials may be effected by a convection oven, muffle furnace or any other suitable heating device provided with means for maintaining an inert or non-oxidizing atmosphere (e.g., nitrogen, carbon dioxide or argon) which surrounds the tobacco material being pyrolyzed. The pyrolysis conditions can also be conducted under vacuum conditions to obviate the need for an inert or non-oxidizing atmosphere. The heating time will often depend on the rate of temperature increase, the initial temperature of the oven or heating device, the maximum temperature reached and the degree of thermal degradation desired. Although heating of the extracted tobacco material may be carried out at a constant temperature, the pyrolysis conditions are preferably programmed so that the temperature is increased gradually over a period of time with the maximum temperature levels being maintained for a time sufficient to effect a weight loss of 35 to 90 percent of the entire pyrolysis treatment period. Preferably, the weight loss effected during the pyrolysis treatment is from 45 to 70 percent. These weight loss percentages are based on the initial weight of the tobacco materials used as starting material.

Following the pyrolysis treatment, the inert or non-oxidizing atmosphere is maintained over the pyrolyzed material until it has cooled to temperatures of less than 50° C. The cooled material is normally milled to yield a particulate material having particle sizes of less than approximately 100 microns or, preferably, less than particle sizes of 50 microns. The pyrolyzed material may be reduced to particulate form using commercially available apparatus such as a DM-3C SWECO Vibro-Energy Dry Grinding Mill available from SWECO Inc. of Los Angeles, California. The SWECO mill is suitable for milling the dry pyrolyzed material. It is preferred, however, that the material be placed in water and milled to the desired particle sizes using a suitable mill such as the Model 504 Morehouse mill available from Morehouse-Cowles, Inc. of Los Angeles, California.

The resulting pyrolyzed material has a high carbon content, i.e., greater than about 50 percent by weight. As a result the total particulate matter provided in the mainstream smoke of a cigarette incorporating the pyrolyzed material is reduced by about 50 percent as compared to a cigarette incorporating a typical blend of tobacco material.

The pyrolyzed tobacco materials are converted into a smokable and/or combustible material suitable for use in smoking articles by various methods.

One method involves contacting the pyrolyzed material with tobacco extract to provide a tobacco derived product. The tobacco extract can have various forms, and optionally can be the tobacco extract within the solvent provided by the previously described extraction technique. For example, it is desirable to subject an aqueous extract to a spray drying, freeze drying, belt drying, flash drying, or other suitable solvent removal process, to provide a tobacco extract having a low moisture content. As such, tobacco extracts can have the form of a paste, a viscous liquid, a powder, a granular solid, a gel, or the like. Tobacco extracts can be processed as described in European Patent Application Nos. 326,370 and 338,831. Typically, tobacco extracts are provided in the form of spray dried extracts, freeze dried extracts, tobacco essences, or the like.

For purposes of this invention, spray drying is a one-step continuous process for removing a liquid from a solution and producing a dried particulate form of the extracted components within the solution by spraying a feed of the solution into a hot drying medium. Representative spray drying processes are described in U.S. Pat. No. 3,398,754 to Tughan and European Patent Application No. 326,370. For purposes of this invention, freeze drying is an indirect, batch or continuous process for removing the liquid from a solution and producing a dried form of the extracted components by freezing the solution and drying the solution in a frozen state through sublimination under high vacuum. A representative freeze drying process is described in U.S. Pat. No. 3,316,919 to Green. Methods and conditions for providing extracted materials in a solid form (e.g., as a powder) will be apparent to the skilled artisan.

The pyrolyzed material optionally is contacted with aerosol-forming materials, flavoring agents and the like. The preferred aerosol-forming materials include glycerin, propylene glycol, and any other materials which yield a visible aerosol when heated. The flavoring agents can vary, and include menthol, vanillin, citric acid, malic acid, levulinic acid, cocoa, licorice, and the like, as well as combinations thereof.

The manner in which the extract, aerosol-forming materials, flavoring agents and the like are contacted with pyrolyzed material can vary. For example, the previously identified contacting materials can be applied to the pyrolyzed material in a conventional tumbling drum using a spray nozzle; the apparatus described in U.S. Pat. No. 4,887,619 to Burcham et al herein incorporated by reference; or using a casing cylinder commercially available from Hauni-Werke Korber & Co. KG to spray the contacting material to pyrolyzed material on a moving conveyor belt. Other techniques for applying contacting materials to the pyrolyzed material will be apparent to the skilled artisan.

Another method of converting the pyrolyzed material into a smokable and/or combustible tobacco material suitable for use in smoking articles involves forming the pyrolyzed material into a predetermined shape. In particular, the pyrolyzed material is combined with binders and sufficient liquid (e.g., water) to produce a paste or the like that can be shaped and dried. The binders which may be used are well known in the art. A preferred binder is sodium carboxymethylcellulose ("SCMC"), which may be used alone, which is preferred, or in conjunction with materials such as sodium chloride, vermiculite, bentonite, calcium carbonate, and the like. Other useful binders include gums, such as guar gum, other cellulose derivatives, such as methylcellulose and carboxymethylcellulose ("CMC"), hydroxypropyl cellulose, starches, alginates (e.g., ammonium alginate), and polyvinyl alcohols. The binders are selected in appropriate amounts so that the resulting product will have acceptable characteristics. For example, the shaped material should have sufficient tensile strength to withstand further processing in the manufacture of smoking products therefrom, it should have acceptable burning properties, and it should not impart objectionable flavor and aroma characteristics when burned during use.

Another method of converting the pyrolyzed material to smokable and/or combustible tobacco material for use in smoking articles involves forming it into a fuel element. In particular, the pyrolyzed tobacco material is preferably admixed with a binder (previously described), water, and additional ingredients (as desired) and shaped or formed into the desired fuel element using extrusion or pressure forming techniques. A wide range of binder concentrations can be utilized. Preferably, the amount of binder should be limited to minimize contribution of the binder to undesirable combustion products which may affect the taste; while sufficient binder is employed to hold the fuel element together during manufacture and use. Generally, the pyrolyzed material/binder admixture is prepared such that a stiff, dough-like consistency is achieved such as described in European Patent Application No. 236,992 to Farrier et al. herein incorporated by reference. The term, "stiff, dough-like" refers to the propensity of the admixture to retain its shape, i.e., at room temperature, a ball of the admixture will show only a very slight tendency to flow over a 24 hour period.

The carbon content of these preferred fuel elements is preferably at least about 60 to 70 percent, most preferably about 80 percent or more, by weight. High carbon content fuel elements are preferred because they produce minimal pyrolysis and incomplete combustion products, little or no visible sidestream smoke, and minimal ash, and have high heat capacity.

The fuel elements of the present invention also may contain one or more additives to improve burning, such as up to about 5 weight percent of sodium chloride to improve smoldering characteristics and as a glow retardant. Also, up to about 5, preferably from about 1 to 2 weight percent of potassium carbonate may be included to control flammability. Additives to improve physical characteristics, such as clays like kaolins, attapulgites and the like also may be used.

The preferred fuel elements of the present invention are substantially free of volatile organic material. By that, it is meant that the fuel element is not purposely impregnated or mixed with substantial amounts of volatile organic materials, such as volatile aerosol-forming materials or flavoring agents, which could degrade in the burning fuel. However, small amounts of materials, e.g., water, which are naturally absorbed by the carbon in the fuel element, may be present therein.

In certain embodiments, the fuel element can contain minor amounts of other forms of tobacco such as tobacco lamina, tobacco dust and the like, tobacco extracts, and/or other materials. Amounts of these other forms of tobacco can range up to about 25, normally at about 10 to 20 weight percent.

Fuel elements prepared in accordance with the present invention are useful in preparing certain embodiments of smoking articles of the type described in U.S. Pat. No. 4,708,151 to Shelar; U.S. Pat. No. 4,714,082 to Banerjee et al.; U.S. Pat. No. 4,756,318 to Clearman et al.; U.S. Pat. No. 4,793,365 to Sensabaugh, Jr. et al.; U.S. Pat. No. 4,917,128 to Clearman et al.; U.S. Pat. No. 4,938,238 to Barnes et al.; U.S. Pat. No. 4,928,714 to Shannon; U.S. Pat. No. 4,893,639 to White; and U.S. Pat. No. 4,827,950 Banerjee et al.; and European Patent Publication Nos. 212,234 and 277,519. These articles generally include (1) the fuel element; (2) a physically separate aerosol generating means including an aerosol-forming material, which is attached to one end of said fuel element; and (3) an aerosol delivery means such as a longitudinal passageway in the form of a mouthend piece, longitudinally disposed adjacent to one end of the aerosol generating means.

Preferred fuel elements prepared in accordance with the methods of the present invention are from about 5 to 15 mm, more preferably, from about 8 to 12 mm in length, and from about 2 to 8, preferably about 4 to 6 mm in diameter. In preferred cigarette type smoking articles, fuel elements having these characteristics are sufficient to provide fuel for at least about 7 to 10 puffs, i.e., the normal number of puffs generally obtained by smoking a typical cigarette under FTC smoking conditions (one 35 cc puff of 2 seconds duration every 60 seconds). Preferably, the fuel element prepared by the process of the present invention is provided with one or more longitudinally extending passageways or grooves.

A further method of converting the pyrolyzed material into a smokable material involves forming the pyrolyzed material into a predetermined shape by a casting technique such as described in U.S. Ser. No. Pat. No. 5,074,321, herein incorporated by reference. Normally, this is done by admixing the pyrolyzed material with the previously described binder, and an inorganic filler material, and often includes about 30 to about 70 weight percent, preferably about 35 to about 60 weight percent inorganic filler material; about 10 to about 60 weight percent, preferably about 10 to about 30 weight percent pyrolyzed material; and up to about 10 weight percent, preferably about 2 to about 8 weight percent binding agent. Additionally at least one aerosolforming material and/or at least one flavoring material can be included.

Typical inorganic filler materials can have a fibrous, flake, crystalline, hollow or particulate form. Examples of inorganic filler material include calcium carbonate, calcium sulfate, magnesium oxide, magnesium hydroxide, perlite, synthetic mica, vermiculite, clays, thermally stable carbon fibers, zinc oxide, dawsonite, low density hollow spheres of calcium carbonate, glass spheres, glass bubbles, thermally stable carbon microspheres, calcium sulphate fibers, hollow ceramic microspheres, alumina, and the like. Desirable inorganic materials do not provide, to any significant degree, an undesirable off-taste to the mainstream cigarette smoke during use of the cigarette. Other filler materials are set forth in U.S. Pat. No. 5,074,321, herein incorporated by reference.

The pyrolyzed material, binder and inorganic filler material are formed into an aqueous slurry. The manner in which the slurry is formed can vary. For example, the slurry can be molded into the predetermined shape or a paper-making process can be used to provide a sheet of a smokable tobacco-derived product. Preferably the slurry is cast as a sheet onto a layer of stainless steel or polyethylene. It is highly desirable to cast the slurry as a sheet having a thickness of about 0.2 mm to about 0.6 mm, preferably about 0.3 mm to about 0.5 mm. Manners for casting a slurry will be apparent to the skilled artisan.

The formed slurry is dried to a desired or predetermined moisture level. The manner for drying the formed slurry can vary. For example, the cast slurry can be air dried under ambient conditions or heated on a heated metal surface. Preferably, conditions of airflow are minimized during drying operations in order to minimize destruction of gas bubbles within the formed slurry. Normally, the formed slurry is dried to a moisture level of about 1 to about 10, generally about 2 to about 8 weight percent.

The resulting smokable tobacco material most preferably has the form of filler (e.g., cut filler). As used herein, the terms "filler" or "cut filler" in referring to smokable materials are meant to include smokable materials which have a form suitable for use in the manufacture of smokable rods for cigarettes. As such, filler can include smokable pyrolyzed materials which are blended and are in a form ready for cigarette manufacture. Smokable filler materials normally are employed in the form of strands or shreds as in common in cigarette manufacture. For example, cut filler material can be employed in the form of strands or shreds from sheet-like or "strip" materials. Such strip materials are cut into widths ranging from about 1/5 inch to about 1/60 inch, preferably from about 1/20 inch to about 1/40 inch. Generally, the resulting strands or shreds have lengths which range from about 0.25 inch to about 3 inches.

Another method of forming a smokable material can be provided by an extrusion technique such as described for example in U.S. Pat. No. 4,880,018 to Graves, Jr., et al. herein incorporated by reference. The pyrolysis material is subjected to a size reduction step using a grinder, a hammer mill, ball mill, or other suitable comminuting apparatus. If desired, the size reduction steps can be performed within the barrel of the extruder using a high shear screw element or shear producing screw element. The comminuted pyrolyzed material is transferred to the feed zone of an extruder. The comminuted pyrolyzed material and the previously described binder are dry blended within the extruder and the desired level of moisture is metered into the extruder. Additionally at least one aerosol forming material and/or flavoring material can be included. The moist mixture is subjected to extrusion conditions including an elevated temperature in order to provide a well mixed, semi-soft, semi-solid material while solubilizing components of the binder and activating the binder. The semi-soft, semi-solid material is passed through opening(s) in a die having a predetermined shape, and the resulting extrudate is collected. The manner in which the extrudate is collected can vary and depends upon the desired use of that material. If desired, the extrudate exiting the extruder die can be subjected to treatment using a roller system or to other physical treatment. Such optional physical treatment is particularly desirable for mixtures having moisture contents below about 40 weight percent. The resulting material is cooled to ambient temperature to yield a resilient processed smokable and/or combustible tobacco product.

The extruders useful herein can vary. Although single screw extruders can be employed, preferred extruders are the twin screw extruders of which the corotating twin screw extruders are especially preferred. Of particular interest are the so-called "cooker extruders" which provide for heating of the materials which are introduced within the extruder. Various screw configurations can be employed. For example, screws having combinations of elements for feeding, mixing, pumping, shearing, and the like, can be selected as desired for optimum results. Screws having sections or elements which provide relatively large output capacities, which have interrupted or nonconjugated flights, or which are "counterflighted" or "reversing" also can be employed. Typical screw elements as well as screws having combinations of such elements are available from extruder manufacturers.

Suitable extruders are those extrusion means commercially available as Werner and Pfleiderer Continua 37 27:1 L/D, Wenger TX-52 34:1 L/D and Baker Perkins MPF-50/25:1 L/D. A Brabender single screw extruder equipped with a degassing port and an appropriate screw also can be employed. The specific shape can be controlled by the selection of appropriate dies. Operation of such extruders will be apparent to the skilled artisan.

If desired, extruded pyrolyzed material can be processed along with an amount of other tobacco-derived filler material. For purposes of this invention, the term "other tobacco-derived or non-tobacco filler material" relates to tobacco material as well as to any other material capable of providing a portion of the volume of the smokable material in addition to the tobacco material formed from pyrolyzed tobacco material. Examples of suitable filler materials other than tobacco material, include carbonized cellulosic materials, tobacco substitute materials, organic filler materials such as grains, inorganic filler materials such as previously described or other such materials, and blends thereof. The amount of other tobacco-derived or non-tobacco filler material which is employed relative to the pyrolyzed material depends upon the desired smoking properties and physical characteristics of the ultimate smokable material.

Additionally, before forming the pyrolyzed material into a predetermined shape using any of the techniques previously described, the pyrolyzed material can be densified. As used herein the term "densified" is used to describe the physical change occurring in materials treated in a densifying/spheronizing process, i.e., a process wherein mass is mechanically compacted and shaped by centrifugal forces, in an appropriate apparatus, into a small area. The most preferred apparatus is the "Marumerizer" available from Fuji Paudal Co., distributed by Luwa Corporation of Charlotte, N.C.

The pyrolyzed material is extruded as above into a rod-like shape. In the "Marumerizer," the pyrolyzed material is shaped and densified by centrifugal force over a time period of from about 0.01 to 5 hours. Depending upon the amount of centrifugal force exerted upon the rod-like pyrolyzed material the resulting shape of the densified particles may range from rodlike (generally shorter than as extruded) to spherical (almost perfectly round). All of the possible shapes are useful herein, but the spherical (i.e., round) particles are preferred as these are generally the most densified and can be used as is as substrates such as described in U.S. Pat. No. 4,893,639 to White herein incorporated by reference. It is anticipated that other centrifugal force type densification equipment will provide similar useful materials, and the present invention is not be considered as limited to so-called "Marumerized" materials.

The following examples are provided in order to further illustrate various embodiments of the invention but should not be construed as limiting the scope thereof. Unless otherwise noted, all parts and percentages are by weight.

EXAMPLE 1

A cigarette is prepared as follows:

Cigarettes having lengths of 82 mm and circumferences of 24.8 mm each have tobacco rods of 57 mm length and straw mouthpieces of 25 mm length.

Smokable materials are contained in a circumscribing cigarette paper wrap. The wrap is available as Reference No. 12719 from Ecusta Corp. The cigarette paper wrap is a flax/calcium carbonate paper containing 0.5 percent potassium citrate, and exhibits a permeability of about 52 CORESTA units.

The smokable material is provided as follows: An aged flue-cured tobacco in cut filler form is extracted in a stainless steel tank at concentration of about 1 pound of tobacco per gallon of water. The tobacco is extracted thoroughly so that substantially all the water-soluble extract is removed. The extracted tobacco material is separated from the tobacco extract within the solvent so that about 45 to about 50 percent by weight of the tobacco material is extracted.

The extracted tobacco material is subjected to pyrolysis conditions including a temperature of about 650° C. and a non-oxidizing nitrogen atmosphere for about 2 hours. Such conditions are provided by a muffle furnace Model No. FAI 730 from Thermodyne, Dubuque, Iowa. Then, the heating is ceased, the oven is slowly opened, and the temperature within the oven cooled to ambient temperature in about 4 hours. The thusly formed pyrolyzed material is black in color and has a carbon content of greater than about 50 percent.

The pyrolyzed material is ground in a mortar and pestle into a powder. The powder is mixed 90:10 by weight with carboxymethylcellulose binder available as Type 7H-F from Hercules Corporation and sufficient water is added to produce a viscous slurry.

The slurry is cast onto a sheet of polyethylene and allowed to dry at ambient temperature to a moisture level of from about 12 to 16 percent. The resulting material is a black sheet having a thickness of about 0.02 inch. The sheet is shredded to 32 cuts per inch.

The cut sheet is coated with a spray dried aqueous extract of a blend of Burley, flue-cured and Turkish tobaccos at a rate of 30 g of extract per 100 g of pyrolyzed material to form a smokable tobacco material.

Cigarettes are hand-made. The cigarettes are employed by burning the tobacco rod such that the smokable tobacco material within the paper wrapper burns to yield smoke. The cigarettes are smoked under FTC smoking conditions and yield 4 mg "tar" and 0.03 mg nicotine per cigarette. Such cigarettes exhibit FTC "tar" to nicotine ratios of 13.3.

EXAMPLE 2

The smokable material and cigarette is prepared as in Example 1. However, 50 parts of the smokable material described in Example 1 is blended with 50 parts of a blend of tobacco cut filler. The tobacco cut filler is provided from 5.5 parts strip form flue cured tobacco, 8.5 parts strip form Burley tobacco lamina, 9 parts strip form Oriental tobacco blend, 12 parts strip form reconstituted tobacco from a processed sheet, 8 parts expanded flue-cured tobacco, 4 parts expanded Burley tobacco and 3 parts casing.

The smokable material/tobacco cut filler blend is formed in cigarettes and smoked as in Example 1. The cigarettes yield 12.9 mg "tar" and 0.76 mg nicotine per cigarette. Such cigarettes exhibit FTC "tar" to nicotine ratios of 17.0.

EXAMPLE 3

A cigarette is prepared as in Example 1 with the following exceptions:

Cigarettes are 84 mm in length and each include a filter element of 27 mm length. The filter elements are manufactured as described in Example 1 of U.S. Pat. No. 4,807,809 to Pryor et al.

The smokable material is provided as follows: a starting blend of about 49 parts flue-cured, about 29 parts Burley and about 22 parts Oriental tobaccos in cut filler form is exhaustively extracted with water. The tobacco material blend is extracted thoroughly so that substantially all the water-soluble extractables are removed from the water insoluble (i.e., cellulosic) portion of the tobacco material. The extracted tobacco material is separated from the tobacco extract within the solvent so that about 45 to about 50 percent dry weight of the starting tobacco material is extracted as extract.

The extracted tobaccos are subjected to pyrolysis conditions as in Example 1. The pyrolyzed material is ball-milled. Then, 17 parts of the milled pyrolyzed extracted tobacco material is mixed with 4 parts carboxymethylcellulose, 4 parts glycerol, 50.8 parts calcium carbonate particles, 22.5 parts of an aqueous spray dried tobacco extract, about 1.2 parts of a high nicotine content tobacco extract, 0.5 parts malic acid, and sufficient water to produce a viscous slurry.

Sheets are cast from the slurry on a 24 inch cast sheet line at 0.035 inch thickness, dried and shredded to 32 cuts per inch. Cigarettes are handmade. The cigarettes are employed by burning the tobacco rod such that the smokable tobacco material within the paper wrapper burns to yield smoke. The cigarettes are smoked under FTC smoking conditions and yield 6.8 mg "tar" and 0.79 mg nicotine per cigarette. Such cigarettes exhibit FTC "tar" to nicotine ratios of 8.6.

EXAMPLE 4

The smokable material is prepared as in Example 3. Cigarettes are provided as described in Example 3, except that a 50:50 blend of the smokable material and the starting tobacco cut filler blend of the fluecured, Burley and Oriental tobaccos described in Example 3 is employed.

The smokable material/tobacco cut filler blend is formed in cigarettes and smoked as in Example 1. The cigarettes yield 22.3 mg "tar" and 2.33 mg nicotine per cigarette. Such cigarettes exhibit FTC "tar" to nicotine ratios of 9.6.

That which is claimed is:

1. A process for altering the character of tobacco material comprising the steps of:

(a) extracting a tobacco material using a solvent to provide (i) a tobacco extract within the solvent, and (ii) an extracted tobacco material;

(b) separating the extracted tobacco material from at least a portion of the extract and solvent; and (c) subjecting the extracted tobacco material to pyrolysis conditions of a temperature of about 300° C. to about 1250° C. to effect a weight loss of about 35 to about 95 percent to provide a pyrolyzed material.

2. The process of claim 1 further comprising contacting the pyrolyzed material of step (c) with tobacco extract to provide a tobacco-derived product.

3. The process of claim 1 further comprising contacting the pyrolyzed material of step (c) with the tobacco extract within the solvent provided in step (a) to provide a tobacco-derived product.

4. The process of claim 1 further comprising contacting the pyrolyzed material of step (c) with an aerosol-containing material to provide a tobacco-derived product.

5. The process of claim 1 whereby the solvent is a liquid having an aqueous character.

6. The process of claim 1 whereby at least about 20 percent of the tobacco material is separated as extract from the extracted tobacco material in step (b).

7. The process of claim 1 whereby at least about 40 percent of the tobacco material is separated as extract from the extracted tobacco material in step (b).

8. The process of claim 1 whereby the pyrolyzed material has a carbon content of at least about 60 percent.

9. A process for altering the character of tobacco material comprising the steps of:

(a) extracting a tobacco material using a solvent to provide (i) a tobacco extract within the solvent, and (ii) an extracted tobacco material;

(b) separating the extracted tobacco material from at least a portion of the extract and solvent;

(c) subjecting the extracted tobacco material to pyrolysis conditions of a temperature of about 300° C. to about 1250° C. to effect a weight loss of about 35 to about 95 percent after to provide pyrolyzed tobacco material; and (d) forming the pyrolyzed tobacco material into a predetermined shape.

10. The process of claim 9 whereby the pyrolysis conditions include a temperature of from about 300° C. to about 1250° C. and a non-oxidizing atmosphere.

11. The process of claim 9 or 10 whereby step (d) includes:

admixing the pyrolyzed tobacco material with sufficient liquid to make a formable paste;

forming the paste into a fuel element of predetermined shape; and drying the fuel element.

12. The process of claim 11 whereby the step of forming the paste into a fuel element comprises subjecting the paste to extrusion conditions.

13. The process of claim 11 whereby the step of forming the paste into a fuel element comprises subjecting the paste to molding conditions.

14. The process of claim 9 or 10 whereby the solvent is a liquid having an aqueous character.

15. The process of claim 9 whereby step (d) includes admixing the pyrolyzed tobacco material with sufficient liquid to form a slurry and casting the slurry into a sheet.

16. A process according to claim 15 whereby the slurry includes an inorganic filler material.

17. A process according to claim 9 whereby the slurry includes an inorganic filler material.

18. The process of claim 9 or 10 whereby at least about 20 percent of the tobacco material is separated as extract from the extracted tobacco material in step (b).

19. The process of claim 9 or 10 whereby at least about 40 percent of the tobacco material is separated as extract from the extracted tobacco material in step (b).

20. The process of claim 9 or 10 whereby the pyrolyzed material has a carbon content of from about 60 percent.

21. The process of claim 9 or 10 whereby step (d) includes a admixing the pyrolyzed material with a binder and subjecting the mixture to extrusion conditions to form a tobacco extrudate of predetermined shape.

22. A process for altering the character of tobacco material comprising the steps of:

(a) extracting a tobacco material using a solvent to provide (i) a tobacco extract within the solvent, and (ii) an extracted tobacco material;

(b) separating extracted tobacco material from at least a portion of the extract and solvent;

(c) subjecting the extracted tobacco material to pyrolysis conditions of a temperature of from about 300° C. to about 1250° C. to effect a weight loss of about 35 percent to about 95 percent in a non-oxidizing atmosphere to provide a pyrolyzed tobacco material; and (d) forming the pyrolyzed tobacco material into a predetermined shape.

23. The process of claim 22 further comprising contacting the pyrolyzed material of step (c) with tobacco extract to provide a tobacco-derived product.

24. The process of claim 22 further comprising contacting the pyrolyzed material of step (c) with the tobacco extract within the solvent provided in step (a) to provide a tobacco-derived product.

25. The process of claim 22 further comprising contacting the pyrolyzed material of step (c) with an aerosol containing material to provide a tobacco-derived product.

26. The process of claim 22 whereby the solvent is a liquid having an aqueous character.

27. The process of claim 22 whereby at least about 20 percent of the tobacco material is separated as extract from the extracted tobacco material in step (b).

28. The process of claim 22 whereby at least about 40 percent of the tobacco material is separated as extract from the extracted tobacco material in step (b).

29. The process of claim 22 whereby the pyrolyzed material has a carbon content of at least about 60 percent.

30. The process of claim 22 whereby step (d) includes:

admixing the pyrolyzed tobacco material with sufficient liquid to make a formable paste;

forming the paste into a fuel element of predetermined shape; and drying the fuel element.

31. The process of claim 30 whereby the step of forming the paste into a fuel element comprises subjecting the paste to extrusion conditions.

32. The process of claim 30 whereby the step of forming the paste into a fuel element comprises subjecting the paste to molding conditions.

33. The process of claim 22 whereby step (d) includes admixing the pyrolyzed tobacco material with sufficient liquid to form a slurry and casting the slurry into a sheet.

34. A process according to claim 33 whereby the slurry includes an inorganic filler material.

* * * * *